United States Patent [19]

Hue et al.

[11] Patent Number: 4,815,753

[45] Date of Patent: Mar. 28, 1989

[54] SKI BINDING FOR ATTACHING THE FRONT OF A BOOT TO A CROSS-COUNTRY SKI, AND A PAIR OF SKIS EQUIPPED WITH SUCH BINDING

[75] Inventors: Jean Hue, Annecy; Michel Sauve, Cruseilles, both of France

[73] Assignee: Salomon S.A., Annecy, France

[21] Appl. No.: 942,045

[22] Filed: Dec. 12, 1986

Related U.S. Application Data

[63] Continuation of Ser. No. 489,470, Apr. 28, 1983, abandoned.

[30] Foreign Application Priority Data

Apr. 29, 1982 [FR] France ..... 82 07758

[51] Int. Cl.[4] ..... A63C 9/18

[52] U.S. Cl. ..... 280/615; 280/631

[58] Field of Search ..... 280/611, 614, 615, 618, 280/626, 628, 629, 631, 636, 617; 36/125, 117, 120; 441/70, 76

[56] References Cited

U.S. PATENT DOCUMENTS

| | | | |
|---|---|---|---|
| 2,534,038 | 12/1950 | Lanz | 280/618 |
| 3,404,900 | 10/1968 | Rippetoe | 441/70 |
| 3,514,119 | 5/1970 | Sutherland | 280/617 |
| 4,262,925 | 4/1981 | Plenk | 280/615 |
| 4,309,833 | 1/1982 | Salomon | 280/615 |
| 4,498,687 | 2/1985 | Salomon | 280/615 |

FOREIGN PATENT DOCUMENTS

| | | | |
|---|---|---|---|
| 3015052 | 11/1980 | Fed. Rep. of Germany . | |
| 2096002 | 2/1972 | France . | |
| 2200026 | 4/1974 | France . | |
| 2306721 | 4/1976 | France | 280/615 |
| 2439602 | 5/1980 | France . | |
| 2447731 | 8/1980 | France . | |
| 2498937 | 8/1982 | France . | |

*Primary Examiner*—David M. Mitchell
*Assistant Examiner*—Everett G. Diederiks, Jr.
*Attorney, Agent, or Firm*—Sandler & Greenblum

[57] ABSTRACT

A ski binding for attaching the front of the boot to a cross-country ski. A connection element is provided which has a first portion attached to the ski and has a second portion attached to the front of the boot. The connection element is constructed so as to permit the heel of the boot to pivot about an axis oblique to the longitudinal plane of symmetry of the ski. In one embodiment the connection element is flexible and contains a zone of least rigidity which defines the axis. In another embodiment, the connection element comprises a joint which is oriented so that the axis around which the front of the boot pivots around the joint is oblique to the longitudinal plane of symmetry of the ski. In a preferred embodiment each binding is placed on a ski and is so oriented that the axes from each binding on the pair of parallel skis converge forward and downward.

36 Claims, 11 Drawing Sheets

SKI BINDING FOR ATTACHING THE FRONT OF A BOOT TO A CROSS-COUNTRY SKI, AND A PAIR OF SKIS EQUIPPED WITH SUCH BINDING

This application is a continuation of application Ser. No. 489,470, filed Apr. 28, 1983, now abandoned.

FIELD OF THE INVENTION

The present invention relates to ski binding for attaching the front of a boot to a cross country or touring ski. More specifically, the present invention relates to those bindings in which, in order to produce a good stride for the skier, means are provided so that when the heel is lifted the foot pivots around an axis transverse to the general direction in which the ski moves. This axis is either stationary or may change its angular orientation. An axis that moves by changing its angular orientation is called an instantaneous axis because only at a given instant does it make sense to identify the particular axis around which the heel pivots. This axis is always located at the front end of the foot.

BACKGROUND OF THE INVENTION

Known bindings for cross-country skis in which the front of the boot is attached to the ski and the heel pivots around an axis transverse to the longitudinal axis of the ski, can be classified into two distinct categories. The first, called hinge-type bindings include boot bindings in which the axis is stationary and is separated from the boot as in French patent. Nos. 2,096,002, No. 2,200,026, No. 2,439,602 and No. 2,447,731. This category also includes bindings in which the axis is integrated into a front extension of the boot as in German Patent No. A1-3,015,052, and bindings in which the axis is "virtual", its location being determined by a zone of least rigidity formed by a reduction of the thickness in the transverse direction in a front extension of the boot, as shown in French patent No. 2,306,721.

The second category includes a "flexion" device which bends when the heel is raised. This "flexion" device may comprise an elastic element whose front section is attached to a ski and whose rear section is attached to the toe of a boot. Alternatively, the elastic element itself may comprise a front extension of the toe of a boot. In either case, the elastic element progressively bends during the lifting of the heel, which causes a pivoting of the foot around an instantaneous rotation axis whose angular orientation changes at the same time as the heel pivots. This type of binding is disclosed in French patent No. 2,447,731.

These bindings have led to a great improvement in the stride of the skier by avoiding excessive bending of the boot at the level of the toes. In these bindings the bending is taken into account by the hinge or the flexible element and by encouraging the joints of the foot and of the leg to perform useful work. The stationary or instantaneous pivoting axis that is found in all of the above-mentioned and all equivalent patents is positioned on the surface of the ski and is perpendicular to the ski's longitudinal plane of symmetry, a position which appeared to be the easiest and most appropriate for the skier. However, if one places oneself along the axis of the ski trail, behind a cross country skier, one notes that the heel of the skier, during the lifting of the foot, describes a trajectory which deviates from an ideal vertical plane passing through the trail. Furthermore, one notes that the ski tends to undergo either a large or small rotation around its longitudinal axis. As a result, the ski tends to move away from its optimal position in relation to the trail. The skier responds by unconsciously making an opposing, supplementary effort. This phenomena is due to the bony anatomy of the leg of the skier which is obviously impossible to change.

SUMMARY 0F THE INVENTION

The present invention has as its goal to remedy these disadvantages by proposing a modification in the types of bindings described above, a modification whose purpose is to correct, a priori, these known shortcomings, by changing the variable instantaneous or stationary pivoting axis, so that its direction which will no longer be perpendicular to the longitudinal axis of the ski and horizontal.

The binding which achieves these goals and attaches a boot to a ski, comprises a connection element adapted to connect the front of the boot to the ski, and adapted to permit the heel of the boot to pivot about an axis oblique to the longitudinal plane of symmetry of the ski. The axis may be stationary or the orientation of the axis with respect to the longitudinal plane of symmetry of the ski may be adapted to change. Furthermore, the axis may be parallel to the surface of the ski or may be oblique to the surface of the ski. In another embodiment, the axis may be oblique to both the surface of the ski and the longitudinal plane of symmetry of the ski. Finally, the axis may be located in front of the foot of the skier and may be defined by and pass through the connection element.

In one embodiment, the connection element comprises a flexible element which includes a first portion, a second portion, and a zone of least rigidity. The first portion is adapted to be attached to the ski and the second portion is adapted to be attached to the front of the boot. The zone of least rigidity is the least rigid portion of the flexible element and is positioned between the first and second portions to define an axis oblique to the longitudinal plane of symmetry of the ski. In this embodiment, the axis may be stationary or the orientation of the axis with respect to the longitudinal plane of symmetry of the ski may be adapted to change. Furthermore, the axis may be parallel to the surface of the ski or may be oblique to the surface of the ski. In addition, the flexible element may be an extension of the boot.

The first portion of the flexible element which is adapted to be attached to the ski is the front portion of the flexible element, and the second portion of the flexible element which is adapted to be attached to the front of the boot is the rear portion of the flexible element.

In one embodiment employing the flexible element, the zone of least rigidity is a groove transverse and oblique to the longitudinal plane of symmetry of the ski. Alternatively, the flexible element has top and bottom surfaces and the zone of least rigidity comprises two grooves, one on the top surface and the other on the bottom surface of the flexible element. Each groove defines an axis parallel to the other groove and oblique to the longitudinal plane of symmetry of the ski. The two groups may also each define an axis which is oblique to the surface of the ski. In still another embodiment employing this flexible element, the first portion of the flexible element is attached to a body which is connected to the ski. In this embodiment, the zone of least rigidity comprises a depression defining an axis oblique to the longitudinal plane of symmetry of the ski and which is located between the body and the boot. The flexible element is held inside the body by a pin whose longitudinal axis is substantially parallel to the longitudinal axis of the groove.

In a still further series of embodiments employing this flexible element, the zone of least rigidity may comprise a groove having a constant cross-sectional area or a groove having a cross-sectional area that decreases from one lateral edge of the flexible element to the other lateral edge of the flexible element. The zone of least rigidity may, alternatively, comprise a plurality of grooves either parallel to one another and oriented oblique to the longitudinal plane of symmetry of the ski or arranged so that their longitudinal axes converge. The zone of least rigidity may also comprise a plurality of openings in the flexible element which are spaced different distances from each lateral side of the flexible element. The closer an opening is positioned toward the first lateral side of the flexible element, the smaller its cross-sectional area. These openings may be circular holes. In still another embodiment, the flexible element has two spaced-apart rigid insertions therein. The zone of least rigidity comprises the space between the two insertions.

In another embodiment the connection element comprises a transverse arm, a support element and a locking lever. The transverse arm is adapted to be attached to the boot, and the support element and locking lever are adapted to be attached to the ski. The transverse arm is also adapted to rest on a surface of the support element and the locking lever to define an axis oblique to the longitudinal plane of symmetry of the ski. Transverse axes passing through the transverse arm and passing through the surfaces of the support element and locking lever upon which the transverse arm rests are oblique to the longitudinal plane of symmetry of ski. Also included is a base plate attached to the ski and on which the locking lever is journalled and to which the support element is attached. The axis may be parallel to the surface of the ski or oblique with respect to the surface of the ski.

In still another embodiment of the invention, the connection element comprises a support element and an attachment element. The support element is adapted to hold the boot and the attachment element is adapted to be connected to the ski. The support element is journalled on the attachment element around an axis and the axis around which the support element pivots is oblique to the longitudinal plane of symmetry of the ski. The attachment element comprises two elements each having an opening therein and an axis pin passing through the openings for pivotably connecting the support element to the attachment element. The two elements and their openings are so positioned that an axis passing through both openings is oblique to the longitudinal plane of symmetry of the ski. The two elements and openings are also so positioned that an axis passing through both openings is oblique to the top of the ski.

In another embodiment the connection element comprises an extension having a front section and a rear section. The rear section of the extension is journalled on the front of the boot and the front section of the extension is attached to the ski. The extension is journalled about an axis oblique to the longitudinal plane of symmetry of the ski. A pin may be provided on which the extension is journalled on the boot. The pin is oblique to the longitudinal plane of symmetry of the ski. The axis may be parallel or oblique to the surface of the ski.

Each binding discussed above may be combined with a pair of skis so that one binding is on each ski. When the pair of skis are parallel to one another, the ends of the skis are at the same level and the axes converge. The axes may converge at a point in front of the boot and may also converge downward. Furthermore, the axes may converge both downward and forward.

In addition, in all of the bindings mentioned above, the connection element may be an extension of the boot.

In another embodiment, the apparatus for achieving the above-stated goals is a device for holding a boot to a ski. The device comprises a holding means for holding the front of the boot and a pivoting means for causing the heel of the boot to pivot about an axis oblique to the longitudinal plane of symmetry of the ski when the heel of the boot is raised. Also included is a ski attaching means for attaching the holding means to the ski. In this embodiment, the axis may be stationary or, the orientation of the axis with respect to the longitudinal plane of symmetry of the ski may be adapted to change. Furthermore, the axis may be located in front of the foot of the skier or may be defined by and pass through the pivoting means. In addition, the axis may be parallel to the surface of the ski or oblique with respect to the surface of the ski. Finally, this device may be combined with a pair of skis one binding on each ski. The pair of skis may be parallel to one another so that when they are parallel the ends of the skis are at the same level and the axes on each binding converge.

A still further embodiment of the present invention comprises a holding means and an attaching mans. The holding means pivotably holds the front of the boot and is adapted to permit the heel to pivot out of the longitudinal plane of symmetry of the ski, when the heel is raised in normal use. An attaching means attaches the holding means to the ski.

BRIEF DESCRIPTION 0F THE DRAWINGS

The foregoing and other objects, features and advantages of the present invention will become more apparent to those of ordinary skill in the art to which the invention pertains in light of the following detailed description of the preferred embodiments as discussed and illustrated in the accompanying drawings, in which like reference characters designate like or corresponding parts throughout the several embodiments, and parts that serve similar functions but are not identical are designated by identical numbers having one or more apostrophe's thereafter and wherein:

FIGS. 1, 2, and 3 illustrate a first embodiment of the invention, and show, respectively a longitudinal cross-sectional side view, a top view and a perspective view of the invention;

FIGS. 4, 5, and 6 and **6*a* illustrate a second embodiment of the invention, and show, respectively a partial cross-sectional view, a top view and a perspective view of the second embodiment; FIG. 6*a* is a variation of FIG. 6**;

FIGS. 7 and 8 illustrates, respectively, a partial cross-sectional front view and a perspective view of a third embodiment of the invention;

FIGS. **9*a* and 9*b*** illustrate, respectively, a partial cross-sectional view and a perspective view of a fourth embodiment;

FIGS. 10 and 11 illustrative, respectively, represent a top view and a side view of a fifth embodiment;

FIGS. 12 and 13 illustrate a side view and a top view of a sixth embodiment;

FIGS. 14, 15, 16, 16*a*, 17 and 18 illustrate various alternative embodiments of the flexible elements used in the invention; and FIGS. 19 and 20 illustrate a preferred arrangement of the binding and pivoting axes on a pair of skis, according to the invention.

DETAILED DESCRIPTION OF THE PREFERRED EMBODIMENTS

Figure 1:
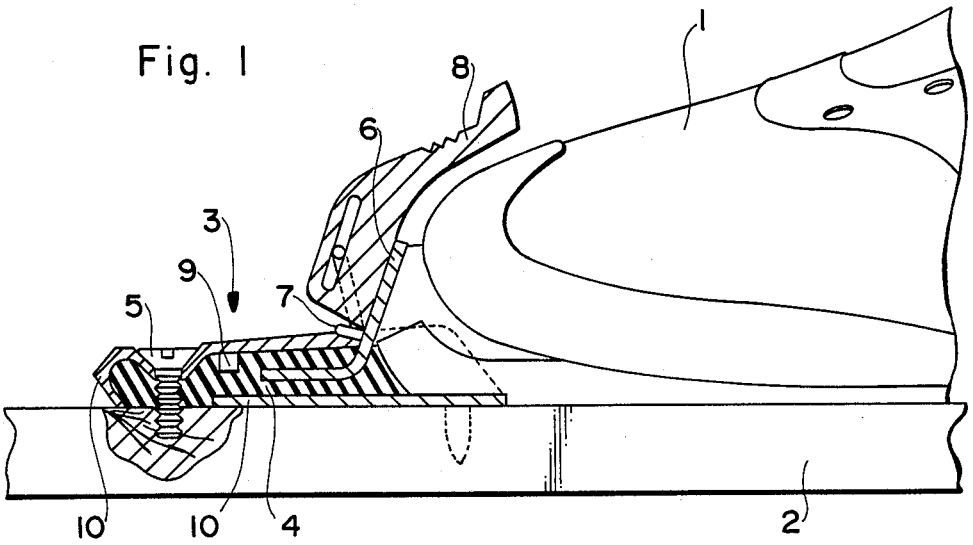
Figure 2:
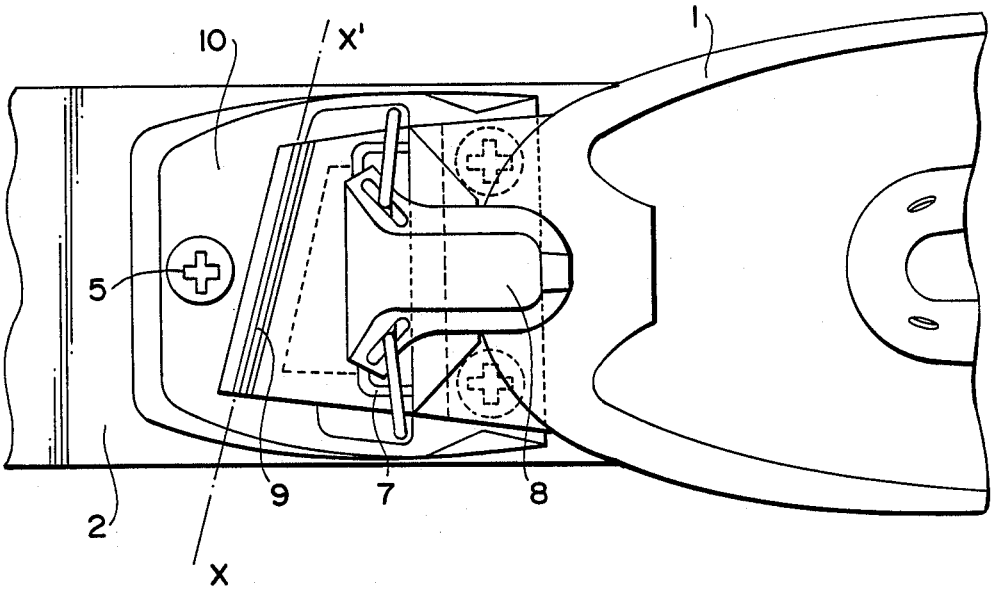

The first embodiment illustrated in FIGS. 1 through 3 relates to a binding wherein a boot is attached to an elastic element which is attached to a ski as is the case, for example, in French patent No. 2,447,731 and No. 2,498,937, which are hereby incorporated by reference.

A binding 3 comprises a connection element connecting the front of a boot 1 to a ski 2. This is accomplished in such a manner that the heel of the boot is pivotable about an axis oblique to the longitudinal plane of symmetry of ski 2. By oblique, applicant means that the axis is not perpendicular to the longitudinal plane of symmetry as the ski, but rather forms angle greater than or less than 90° with respect to the longitudinal plane of symmetry of the ski. The connection element comprises an elastic plate 4 attached to ski 2 at its front portion by a screw 5. The rear portion of plate 4 holds the front of boot 1 by engaging the latching element of the boot. The latching element on front end of the boot comprises a transverse arm 7 which is held against a support 6 by a locking lever 8. Arm 7 is integral with boot 1, and support 6 is integral with plate 4. A metal body 10 laterally holds elastic plate 4 on ski 2 while still allowing plate 4 to move vertically.

Elastic plate 4 is provided with a transverse groove 9 which defines a zone or line of least rigidity which is the least rigid portion of plate 4 and which defines an axis XX′ around which the rear section of plate 4, support element 6 and boot 1 will rotate when the the heel is lifted (as seen in FIG. 3).

It is customary in the art to construct groove 9 so that stationary rotation axis $X_1X'_1$ (FIG. 3) is perpendicular to the longitudinal plane of symmetry of ski 2. To avoid the above-mentioned shortcomings, according to the present invention, groove 9, as can be seen in FIG. 2 is oblique with respect to the longitudinal plane of symmetry of ski 2. Therefore, the axis of the hinge formed by groove 9 around which the heel of boot 2 pivots is oblique with respect to the longitudinal plane of symmetry of ski 1. In normal use, the heel of boot 1 will consequently describe a trajectory T leaving the longitudinal plane of symmetry of the ski, as is illustrated in FIG. 3. Trajectory T differs considerably from trajectory $T_1$ which remains in the longitudinal plane of symmetry of the ski, which is the result of orienting groove 9 perpendicular to the longitudinal plane of symmetry of the ski.

In the example illustrated in FIGS. 1–3, oblique axis XX′ remains horizontal and parallel to the surface of ski 2. In another embodiment for a similar binding described later in reference to FIGS. 7 and 8, this axis will make an angle with the surface of ski 2. In addition, in this embodiment plate 4 is interposed between ski 2 and boot 1. It is within the scope of the invention for plate 4 to be an extension of boot 1, extending from the front thereof, or from the sole thereof.

The second embodiment, shown in FIGS. 4–6, relates to a known state of the art hinge-type binding which is disclosed, for example, in French patent No. 2,439,602 which is hereby incorporated by reference. The front of boot 1 comprises a latching element having a transverse arm 7′ adapted to be attached to the front of the boot. Arm 7′ is adapted to be held between a support element 6′ and locking lever 8′ so that arm 7′ can rotate around its longitudinal axis, as will be described below. Support element 6 is adapted to be attached to a base plate 11 which is attached to ski 2 by screw 5. Element 6 is stationary with respect to the front of the boot. Plate 11 also includes a locking lever 8′ journalled on base plate 11 and blocking the forward movement of said transverse arm 7′ Thus, boot 2 is connected to ski 1 by a connection element comprising support 6′, arm 7′, and lever 8′. Transverse arm 7′ is adapted to rest on a surface of support element 6′ and locking lever 8′ so that it may rotate around its longitudinal axis to define axis XX′, oblique with respect to the longitudinal plane of symmetry of ski 2.

Lifting the heel of boot 1 causes the assembly comprising boot 1 and the latching element comprising transverse arm 7′ to pivot around a stationary rotation axis XX′ defined by transverse arm 7′. According to the invention, the surfaces of support element 6′ and locking lever 8′ between which arm 7′ is held have an oblique orientation with respect to the longitudinal plane of symmetry of ski 2. In other words, transverse axes passing through these surfaces make an oblique angle with respect to the longitudinal plane of symmetry of ski 2. Rotation axis XX′ which can be parallel (FIG. 6) or oblique or sloped (FIG. 6*a*) with respect to the surface of ski 2 will impose on the heel being lifted, a trajectory T which moves away from and out of the longitudinal plane of symmetry of ski 2, as soon as the heel is lifted, as can be seen in FIG. 6.

FIGS. 7 and 8 illustrate an embodiment of the invention similar to the first embodiment described. Elastic plate 4 is attached at its front portion by screw 5 to ski 2. The front of boot 1 is attached to the rear portion of plate 4 in a manner similar to that of the first embodiment. Unlike the first embodiment, plate 4 comprises two grooves 9′ located between the attachment point to the ski at screw 5 and the front of the boot 1. One groove is on the top surface and the other groove is on the bottom surface of plate 4. The material between each groove defines an axis parallel to the other groove. In addition, each groove 9′ is oblique with respect to the longitudinal plane of symmetry of the ski and with respect to the surface of the ski. The material between the two grooves is a zone of least rigidity and defines stationary pivoting axis XX′ around which the heel of boot 1 pivots. By this arrangement, the heel of boot 1 pivots away from and out of the longitudinal plane of symmetry of the ski when it is raised.

FIGS. 9*a* and 9*b* illustrate another hinge-type system corresponding to another binding proposed in French patent No. 2,447,731, cited above. The connection element connecting boot 1 to ski 2 comprises support element 6″ and attachment 12. Support element 6″ is adapted to hold the front of boot 1 and is connected to ski 2 in such a way as to pivot around an axis XX′ defined by two attachment elements 12 located on base plate 11. More specifically, element 6″ is journalled on a pin passing through openings in each attachment 12. The axis passing through holes or both openings in each attachment 12 defines axis XX′ around which element 6 and the heel of boot 1 pivot. According to the invention, the position and geometry of attachments 12 and their holes are such that axis XX' makes an angle $\alpha$ oblique with respect to the top of the ski, and an angle $\beta$ with respect to a line perpendicular to the longitudinal plane of symmetry of the ski. Thus, axis XX' is oblique with respect to the longitudinal plane of symmetry of the ski. By this arrangement the heel of boot 1 pivots away from and out of the longitudinal plane of symmetry of the ski when raised.

FIGS. 10 and 11 illustrate another embodiment of the invention comprising a hinge system in which the front of boot 1 has an extension 13 similar to that found in French patent No. 2,306,721 which is hereby incorporated by reference. Extension 13 extends from the front of boot 1 and is introduced into a metal body 10 having lateral wings and attached to ski 2. A pin 14 passes through the lateral edges of body 10 and a hole provided in extension 13 to attach boot 1 on ski 2. Thus, the connecting element connecting boot 1 to ski 2 comprises extension 13, body 10, and pin 14.

Between the front of the binding attached to the ski and the actual end of boot 1 a thinner zone 16 of least rigidity is provided in extension 13. Zone 16 is thinner than the rest of extension 13 and defines a stationary pivot axis around which the heel of boot i pivots when raised. According to the invention, zone 16 comprises a depression and is obliquely oriented with respect to the longitudinal plane of symmetry of ski 2 as is the case with groove 9 above described. Extension 13 may be an extension of boot 1, or of the sole of boot 1, or may be an element interposed between boot 1 and ski 2.

The invention also has an application in hingetype systems having a non-flexible extension which extends from the front of the boot and pivots around a joint comprising a true hinge, as in German patent No. A1 3,015,052 which is hereby incorporated by reference. This embodiment is illustrated in FIGS. 12 and 13. The connecting element connecting the front of boot 1 with ski 2 in this embodiment comprises an extension 26 and binding 28. The front of boot 1 has an extension 26 journalled thereon at its rear section around a rotation axis pin 17, so as to comprise a true hinge. Extension 26 is itself connected to ski 2 by an appropriate binding 18. To obtain the desired technical effect of the heel of the boot moving out of the longitudinal plane of symmetry of the ski, axis pin 17 is not oriented perpendicular to the longitudinal plane of symmetry of ski 2, as is customary, but rather pin 17 is sloped or oblique with respect to a line perpendicular to the longitudinal plane of symmetry of the ski. In addition, pin 17 may be parallel or oblique with respect to the surface of ski 2.

Bindings which are not hinge-type bindings are of two types: those having a flexible element which is interposed between the boot and the ski, or those in which the flexible element is an extension of the boot. In either of these bindings having a flexible element, the pivoting axis is an instantaneous axis which gradually changes its angular orientation as is seen in FIGS. 25–28, 31 and 32 of French patent No. 2,447,731 In this type of binding one can design the flexible element so that even when the orientation of the axis changes, the orientation of the instantaneous axis remains oblique with respect to the longitudinal plane of symmetry of the ski. Flexible elements having such a configuration are shown in FIGS. 14–18. Flexible element 19 in these embodiments may be integral with the front of the boot or the sole of the boot, or may be interposed between the ski and boot to connect these two elements.

FIG. 14 shows a groove 9'' in flexible element 19 having a constant, cross-sectional area and which is oblique with respect to the longitudinal plane of symmetry of the ski. Groove 9'' is the zone of least rigidity in flexible element 19. As seen in FIG. 15, oblique groove 9''' may decrease in cross-sectional area from one lateral edge of element 19 to the other. In the embodiment illustrated in FIG. 16, several oblique grooves 9'''' may be formed in element 19 in a cluster. The longitudinal axes of each groove converges towards one lateral edge of element 19. Alternatively, the grooves could be parallel to one another, as seen in FIG. 16*a*. In FIG. 17 the oblique angle between the instantaneous rotation axis and the longitudinal plane of symmetry of the ski is ensured by openings or holes 20 in element 19 which decrease in cross-sectional area from one lateral edge to the other. In other words, the closer an opening is to one lateral edge of element 19, the smaller its cross-sectional area. In FIG. 18 unconnected, spaced apart, rigid insertions 21 which define between them a privileged oblique axis, oblique with respect to the longitudinal plane of symmetry of the ski, are molded inside element 19. These alternative embodiments can obviously be used in combination each time that a flexible element is used between a boot and a ski.

To obtain the optimal desired effect of the heel moving out of the longitudinal plane of symmetry of the ski with any and all of the bindings described above each pair of parallel skis on which any of the bindings discussed above are used should have their ends at the same level, and the stationary or instantaneous rotation axes for the bindings on the right and left skis should be designed so as to converge forward to a point A. An even better result is obtained if these axes converge downward or converge downward and forward. This embodiment is illustrated in FIGS. 19 and 20.

This present invention may be carried in other specific ways than those herein set forth without departing from the spirit and essential characteristics of the invention. The present embodiments are, therefore, to be considered in all respects as illustrative and not restrictive and various modifications and changes may be made without departing from the scope of the present invention.

What is claimed is:

1. A binding for attaching a boot to a ski comprising a connection element comprising means for connecting and locking the front of said boot to said ski and for permitting repeated upward and downward pivoting of the heel of said boot from a rest position while holding the front of said boot on said ski, said boot pivoting through a continuous trajectory from said rest position about an axis oblique with respect to the longitudinal axis of said ski.

2. The binding of claim 1 wherein said axis is stationary with respect to said ski.

3. The binding of claim 1 wherein said connection element comprises means for changing the orientation of said axis with respect to said longitudinal plane of symmetry of said ski.

4. The binding of claim 1 wherein said axis is located in front of the foot of the skier.

5. The binding of claim 1 wherein said ski comprises a top surface and wherein said axis is parallel to the plane of the top surface of said ski.

6. The binding of claim 1 wherein said ski comprises a top surface and wherein said axis is oblique to the plane of the top surface of said ski.

7. The binding of claim 1 wherein said axis is defined by and passes through said connection element.

8. The binding of claim 1 wherein said connection means comprises a flexible element comprising:

(a) a first portion adapted to be attached to said ski;

(b) a second portion adapted to be attached to the front of said boot; and (c) a zone of least rigidity, being the least rigid portion of said flexible element, positioned between said first and second portions, and defining said axis oblique to the longitudinal plane of symmetry of said ski.

9. The binding of claim 8 wherein said first portion is a front portion, and said second portion is a rear portion.

10. The binding of claim 9 wherein said zone of least rigidity is a groove transverse and oblique to the longitudinal plane of symmetry of said ski.

11. The binding of claim 10 wherein said flexible element has top and bottom surfaces and said zone of least rigidity comprises two grooves, one on said top surface and one on said bottom surface, each groove defining an axis parallel to the other groove and oblique to the longitudinal plane of symmetry of said ski.

12. The binding of claim 11 wherein said two grooves each define an axis which is also oblique to the plane of said top surface of said ski.

13. The binding of claim 8, said connection element further comprising a body attached to said ski, wherein said first portion is attached to said body and said zone of least rigidity comprises a depression defining an axis oblique to the longitudinal plane of symmetry of said ski and located between said body and said boot.

14. The binding of claim 13 wherein said flexible element is held inside said body by a pin, whose longitudinal axis is substantially parallel to the longitudinal axis of said groove.

15. The binding of claim 8 wherein said zone of least rigidity comprises a groove having a constant cross-sectional area.

16. The binding of claim 8 wherein said flexible element has two lateral edges and said zone of least rigidity comprises a groove having a cross-sectional area that decreases from one lateral edge to the other lateral edge.

17. The binding of claim 8 wherein said zone of least rigidity comprises a plurality of grooves parallel to one another and oriented oblique to the longitudinal plane of symmetry of said ski.

18. The binding of claim 8 wherein said zone of least rigidity comprises a plurality of grooves whose longitudinal axes converge.

19. The binding of claim 8 wherein said flexible element has first and second lateral sides, and wherein said zone of least rigidity comprises a plurality of openings in said flexible element spaced different distances from said lateral sides, wherein the closer an opening is positioned toward said first lateral side, the smaller its cross-sectional area.

20. The binding of claim 19 wherein said openings are circular holes.

21. The binding of claim 8 wherein said flexible element has two spaced-apart rigid insertions therein, wherein said zone of least rigidity comprises the space between said two insertions.

22. The binding of claim 1 wherein said connection element comprises:

a transverse arm adapted to be attached to said boot;

a support element adapted to be attached to said ski; and a locking lever, adapted to be attached to said ski, wherein said transverse arm is adapted to rest on a surface of said element and said locking lever to define said axis oblique to the longitudinal plane of symmetry of said ski.

23. The binding of claim 22 wherein the transverse axes passing through said transverse arm, and passing through said surface of said support element and said locking lever upon which said transverse arm rests, are oblique to said longitudinal plane of symmetry of said ski.

24. The binding of claim 23 further including a base plate attached to said ski and on which said locking lever is journalled and to which said support element is attached.

25. The binding of claim 1 wherein said connection element comprises:

a support element, adapted to hold said boot; and an attachment element adapted to be connected to said ski, on which said support element is journalled around said axis, wherein the axis around which said support element pivots is oblique to the longitudinal plane of symmetry of said ski.

26. The binding of claim 25 wherein said attachment element comprises two elements each having an opening therein, and an axis pin passing through said openings, pivotally connecting said support element to said attachment element, wherein said two elements and said opening are so positioned that an axis passing through both openings is oblique to said longitudinal plane of symmetry of said ski.

27. The binding of claim 26 wherein said ski comprises a top surface, wherein said two elements and said openings are so positioned that an axis passing through both openings is oblique to the plane of the top surface of said ski.

28. The binding defined by claim 1 in combination with a pair of skis, one binding on each ski, wherein each binding is adapted to attach a boot to a ski, wherein said bindings together comprise two oblique axes, wherein said oblique axes converge when said pair of skis are parallel to one another in the same horizontal plane.

29. The binding as defined by claim 28 in combination with said pair of skis wherein said axes converge at a point in front of said boot.

30. The binding in combination with said pair of skis as defined by claim 28 wherein said axes converge downwardly.

31. The binding in combination with said pair of skis as defined by claim 30 wherein said axes also converge at a point in front of said boot.

32. A binding for attaching a boot to a ski comprising a connection element comprising means for connecting and locking the front of said boot to said ski and for permitting repeated upward and downward movement of the heel of said boot from a rest position while holding the front of said boot on said ski, said connection element connects to the boot to allow for pivoting of the boot about an axis which is fixed and oblique with respect to the longitudinal axis of the ski during the upward and downward pivoting of the heel of said boot.

33. The binding of claim 32 wherein said connection element comprises:

an extension having a front section and a rear section, journalled on the front of said boot at its rear section, and attached to said ski at its front section, wherein said extension is journalled about said axis oblique to the longitudinal plane of symmetry of said ski.

34. The binding of claim 33 further comprising a pin on which said extension is journalled on said boot, wherein said pin is oblique to the longitudinal plane of symmetry of said ski.

35. The binding of claim 32 said connection element is an extension of said boot.

36. The binding defined by claim 32 wherein said connection element is uninclined with respect to the top surface of said ski.

* * * * *

UNITED STATES PATENT AND TRADEMARK OFFICE

CERTIFICATE OF CORRECTION

PATENT NO. : 4,815,753

DATED : March 28, 1989

INVENTOR(S) : Jean HUE et al.

It is certified that error appears in the above-identified patent and that said Letters Patent is hereby corrected as shown below:

At column 4, line 33, change "mans" to ---means ---.

At column 4, line 61, change "illustrates" to ---illustrate---.

At column 6, line 13, insert ---.--- after "7'".

At column 7, line 24, change "booti" to ---boot l---.

At column 7, line 32, change "hingetype" to --- hinge-type---.

Signed and Sealed this

Sixth Day of March, 1990

*Attest:*

JEFFREY M. SAMUELS

*Attesting Officer*

*Acting Commissioner of Patents and Trademarks*